United States Patent [19]

Goldner

[11] 4,370,911

[45] Feb. 1, 1983

[54] POINTLESS END PIN ADAPTOR FOR THE VIOLONCELLO AND THE STRING BASS

[76] Inventor: Richard Goldner, 3717 Toad Lake Rd., Bellingham, Wash. 98226

[21] Appl. No.: 343,232

[22] Filed: Jan. 27, 1982

Related U.S. Application Data

[63] Continuation-in-part of Ser. No. 225,845, Jan. 16, 1981.

[51] Int. Cl.[3] ..... G10G 5/00

[52] U.S. Cl. ..... 84/280

[58] Field of Search ..... 84/280 C, 327

[56] References Cited

U.S. PATENT DOCUMENTS 2,447,080 8/1948 Meier ..... 84/280 C 4,316,402 2/1982 Goldner ..... 84/280 C

*Primary Examiner*—Lawrence R. Franklin

*Attorney, Agent, or Firm*—Reed, Smith, Shaw & McClay

[57] ABSTRACT

A pointless end pin adaptor for the violoncello and the string bass which comprises an end pin receiving member having an outer nonslip support surface with an arcuate portion adapted to contact the floor. The receiving member includes a cavity for receiving the existing end pin of a violoncello or string bass in the case of retrofit applications, or a rod projecting from the receiving member for replacement of existing pins. Means are also provided for securely locking an existing end pin into the cavity of the receiving member.

6 Claims, 2 Drawing Figures

POINTLESS END PIN ADAPTOR FOR THE VIOLONCELLO AND THE STRING BASS

RELATED U.S. APPLICATION

This is a continuation-in-part application of United States Patent No. (Ser. No. 225,845) filed Jan. 16, 1981.

FIELD OF THE INVENTION

The invention relates to a pointless end pin adaptor for replacement or retrofit use on musical instruments requiring an end pin for support on a floor or other surface, and, in particular, an improved end piece for the violoncello and string bass.

BACKGROUND OF THE INVENTION

The violoncello and string bass are instruments that require an end pin for support on a floor or other support surface. Generally, these end pins can be retracted into the body of the instrument when not in use and can be adjusted outwardly to suit the build and preference of the player. The angle between the end pin and the floor normally varies from player to player. For example, some cellists use an end pin which is permanently angularly bent to permit a relatively acute angle between the instrument and the floor. However, such angularity is fixed rather than adjustable and does not allow the end pin to fully retract into the instrument and at least portions of them have to be carried separately.

The more acute the angle between the instrument and the floor the greater likelihood there is that the instrument will slip during play. On many surfaces such as concrete, marble and the like and most wooden floors such as used on stages, rostrums and podiums it is difficult to find reliable anchor points for the end pins. Various devices have been used to secure or anchor these instruments independently from the quality or nature of the floor surface. Devices such as a sponge rubber with a metal cup or pieces of wood attached to the leg of a chair are being used. Rubber tips are generally used to avoid injury and to protect the point of the pin. Their surface contact is not very effective to prevent slippage, except perhaps on a carpet-type surface. Moreover, with the assertion of any pressure on the instrument, the pin will penetrate the protective rubber tip.

For the most part, the devices available are generally unsatisfactory in that they must be separately carried and are easily forgotton, require set up time or do not eliminate instrument slippage. Devices such as metal cups do not provide secure support when the instrument is in an acute angle to the floor. Accordingly, it is an object of the present invention to overcome the disadvantages of the prior art devices and to provide an end pin which can be adjusted to virtually any position with the floor while at the same time greatly reducing or eliminating the possibility of the instrument slipping. It is a further object of the present invention to provide an end pin adaptor which may be used to replace the retractable end pin of the instrument or may be fitted onto an existing end pin by the player. It is also an object of the present invention to provide an end pin which is adaptable to any type of floor surface to prevent both damage to the floor and the pin itself.

SUMMARY OF THE INVENTION

Generally, the end pin adaptor of the present invention comprises a receiving member preferably molded or machined from a material such as Delrin ®or equivalent polymer, hard rubber or other suitable material. The receiving member includes an outer support surface having an arcuate portion.

In applications where the adjustable end pin of the present invention is to be mounted to an existing end pin of a violoncello or string bass, the receiving member includes a cavity which is configured to receive the existing end pin of the instrument. A locking means positioned adjacent to or integral with the cavity is provided to lock the existing end pin to the receiving member. Preferably, such locking means comprises two pairs of set screws positioned in the receiving member or a collar mounted to the receiving member adjacent to cavity.

In the case where the end pin of the present invention is to be used as a replacement for the existing end pin of the violoncello or string bass, a rod is positioned within the cavity for mounting to the instrument. Alternatively, the receiving member may include an integrally molded or machined cylindrical extension adapted to mount to the instrument.

The outer support surface of the receiving member is provided with an outer overlay having a flexible, nonslip surface, such as from neoprene, rubber or other plastic material, to support the instrument when in use. Preferably, a second or intermediate overlay is provided between the outer support surface and nonslip overlaying surface which may be made from the same material. Additionally, the nonslip surface may be provided by etching the underlying support surface, but this is not a preferred method.

In the preferred embodiment of the invention, the outer end intermediate overlays are removably positioned over the arcuate outer surface of the receiving members. In such embodiment each overlay includes a pair of openings which are adapted to fit over the end of an associated set screw used to lock the end pin of the instrument into the cavity of the receiving member. Accordingly, it is possible to use the locking set screws to both secure the end pin as well as position the overlays. Other advantages of the present invention will become apparent from a perusal of the following detailed description of a presently preferred embodiment of the invention taken in connection with the accompanying drawings.

PRESENTLY PREFERRED EMBODIMENT

Figure 1:
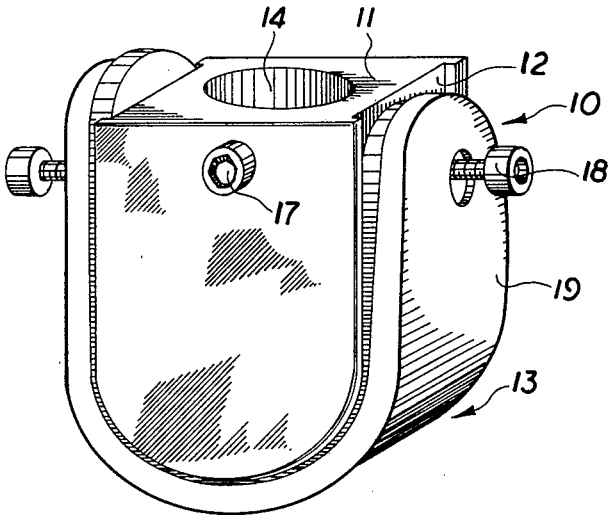
FIG. 1 is a perspective view of the preferred embodiment of the end pin adaptor of the present invention.
Figure 2:
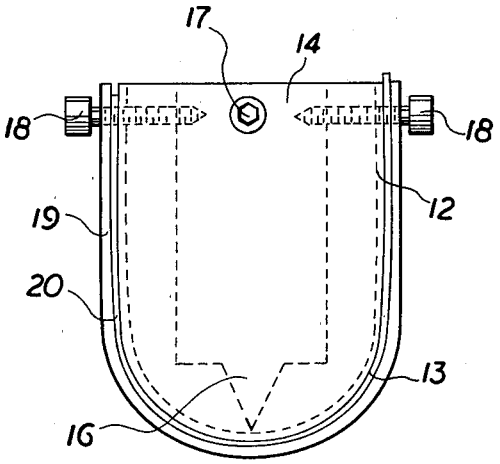
FIG. 2 is a side elevation of the end pin adaptor shown in FIG. 1.

In FIGS. 1 and 2, end pin adaptor 10 of the present invention is shown. End pin adaptor 10 includes a receiving member 11 having a slightly recessed support surface 12. Support surface 12 includes arcuate portion 13 at one end which is adapted for contact with a floor or other instrument support surface. Receiving member 11 includes a cavity 14 preferably sized and configured to receive an existing end pin of a violoncello or string bass. As shown, cavity 14 includes conical base 16 which accommodates the point of an existing end pin. The means for locking receiving member 11 to an end pin comprises two pair of set screws 17 and 18. Preferably, set screws 18 project outwardly from receiving member 11 even when they are in the lock-tight position against an end pin. Projecting screws 18 are used to position and hold the surface overlays.

Adaptor 10 includes an outer overlay 19 and an inner overlay 20. Both overlays are preferably made from neoprene and are shaped to fit with the recess of support surface 12. Further, it is desirable that each overlay 19 and 20 include a pair of openings at their respective end so as to fit over set screws 18. Accordingly, it is preferable to make each overlay of length equal to or slightly less than the perimeter distance of surface 12 between set screws 18. By making the length slightly less than the surface distance, the elastic expansion of the overlays assures their secure positioning on support surface 12.

While two overlays are preferred, it is possible to utilize only outer overlay 19. A satisfactory adaptor is achieveable, but it has been found not to be as good from a performance standpoint as those with the preferred two overlays. It is not presently known why that is.

By providing removable overlays, each may be easily replaced if worn or damaged. Moreover, various surface finishes may be placed on outer overlay 19 to better adapt the end piece adaptor to a particular type of floor surface.

While a presently preferred embodiment of the invention has been shown and described in detail, it may be otherwise embodied within the scope of the appended claims.

What is claimed is:

1. An end pin adaptor for the violoncello and the string bass comprising a receiving member having an arcuate support portion at one of its ends and a cavity opening at its other end adapted to receive the end pin of a violoncello or string bass, a locking means adjustably positioned on said receiving member to lock said member to an end pin positioned in said cavity and at least one flexible overlay positioned over said arcuate support portion of the receiving member.

2. An end pin adaptor as set forth in claim 1 wherein said overlay is positioned over said arcuate support by said locking means.

3. An end pin adaptor as set forth in claim 1 wherein said overlay is removably positioned over said arcuate support.

4. An end pin adaptor as set forth in claim 1 wherein said overlay is removably positioned over said arcuate support by means of said locking means.

5. An end pin adaptor as set forth in claims 2, 3 or 4 including a second overlay positioned between said arcuate support surface and said other overlay.

6. An end pin adaptor as set forth in claim 1 wherein said arcuate support surface is recessed.

* * * * *